United States Patent [19]

Bailey

[11] 4,002,335

[45] Jan. 11, 1977

[54] TOY BANK WITH COIN RETURN

[76] Inventor: Richard B. Bailey, 3000 Dunes Circle, Reno, Nev. 89502

[22] Filed: July 28, 1975

[21] Appl. No.: 599,742

Related U.S. Application Data

[63] Continuation of Ser. No. 440,908, Feb. 8, 1974, abandoned.

[52] U.S. Cl. ..... 273/1 E; 46/3; 232/4; 273/143 R

[51] Int. Cl.[2] ..... A63H 33/30; A63F 5/04

[58] Field of Search ..... 273/143 R, 143 A, 143 B, 273/143 C, 143 D, 143 E, 138 A, 1 E; 46/2, 3, 4, 5; 232/4

[56] References Cited

UNITED STATES PATENTS 3,658,340 4/1972 Ohki ..... 273/143 R

*Primary Examiner*—Richard C. Pinkham
*Assistant Examiner*—Arnold W. Kramer
*Attorney, Agent, or Firm*—Nilsson, Robbins, Dalgarn & Berliner

[57] ABSTRACT

A toy bank is disclosed for accumulating coins while providing the fascination of a spinning-reel mechanism that designates predetermined winning-position combinations which return coins. Coins are returned by a delivery unit incorporating a sliding leaf that is reciprocated under a coin stack by a rotary structure which is variously actuated in accordance with specific winning combinations indicated by the reels. As disclosed, feeler-gauge structures mate with indices on the reels to control switches that are associated with different winning combinations. Different switch members establish different angular displacement of a drive mechanism thereby acting through an electro-mechanical counter to control the number of reciprocal motions by the sliding leaf and accordingly determining the number of coins delivered.

2 Claims, 5 Drawing Figures

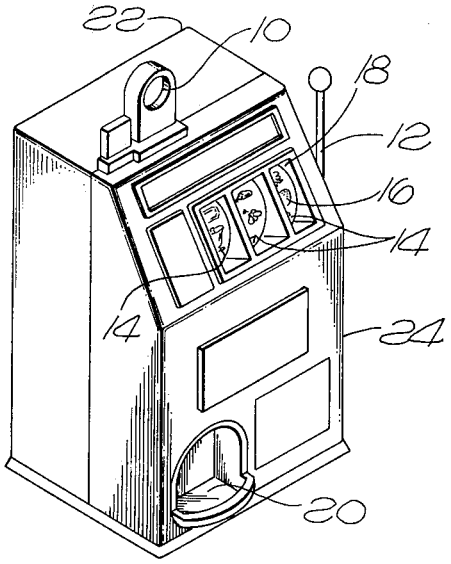
FIG. 1.
FIG. 2.
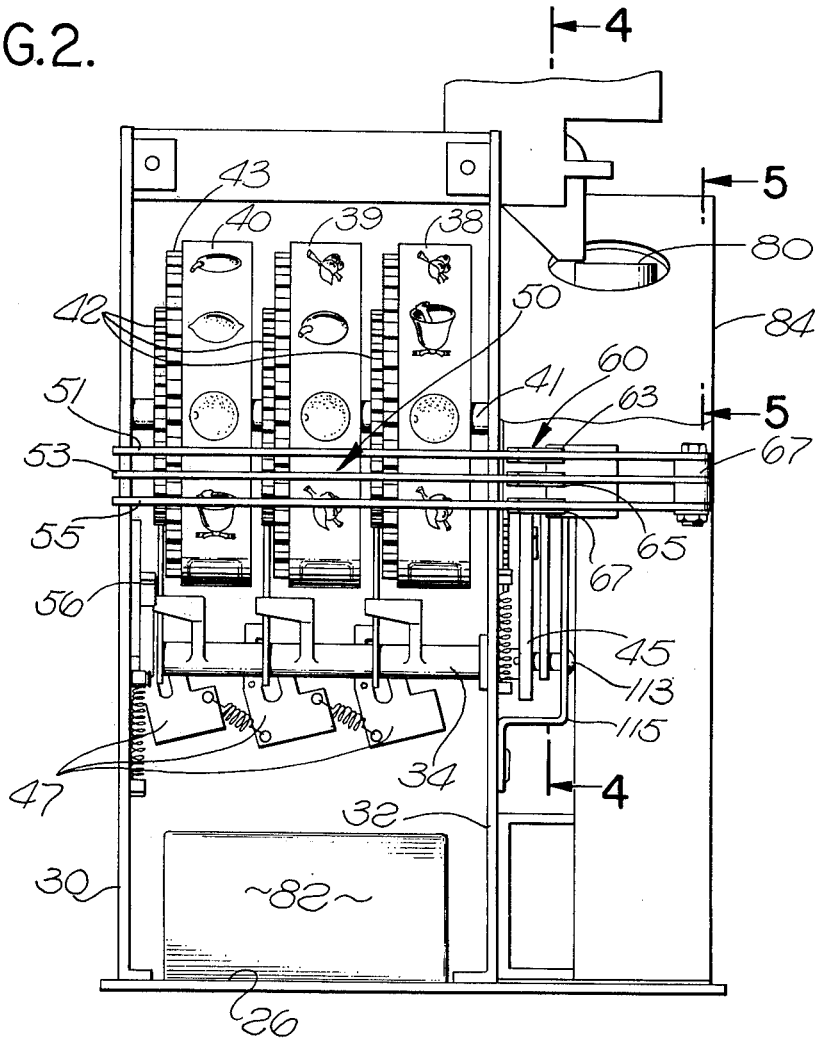

TOY BANK WITH COIN RETURN

This is a continuation of application Ser. No. 440,908, filed Feb. 8, 1974, and now abandoned.

BACKGROUND AND SUMMARY OF THE INVENTION

Various forms of novelty or toy banks have been previously proposed with the objective of entertaining the depositor as coins are inserted. One form of such a bank is disclosed in U.S. Pat. No. 3,464,693 on which the present invention represents an improvement. Generally, the bank described in the above-referenced patent has been determined to be an effective operating unit; however, in due course the need became apparent for an improved structure. In general, the present invention is directed to a toy bank incorporating a combination of cooperating elements including apparatus for returning coins to the depositor in accordance with predetermined winning position combinations for the reels.

Somewhat more specifically, the present invention is directed to a simple, economical mechanism embodied as a coin bank with spinning reels to designate predetermined, winning combinations. A feeler mechanism senses notched indices on the reels to detect the predetermined winning combinations and control an electrical switching structure to energize a coin-delivery mechanism. Coins are dispensed by a sliding leaf which is reciprocated under a coin-holding tube, the leaf being actuated by a rotary structure which actuates an electro-mechanical counting apparatus for cooperation with the switching mechanism to control the number of coins dispensed.

BRIEF DESCRIPTION OF THE DRAWINGS

In the drawings, which constitute a part of this specification, an exemplary embodiment exhibiting various objectives and features hereof is set forth, specifically:

FIG. 1 is a perspective view of a toy bank constructed in accordance with the present invention;

FIG. 2 is a rear elevation view of the apparatus of FIG. 1 with the external housing removed;

DESCRIPTION OF THE ILLUSTRATIVE EMBODIMENT

Figure 3:
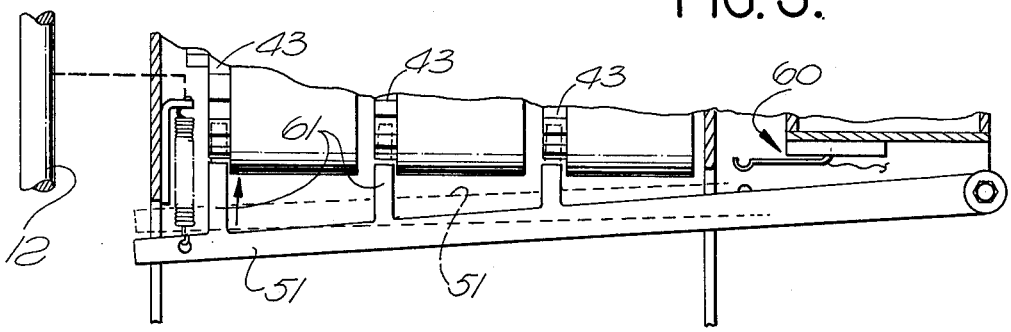
FIG. 3 is a fragmentary plan view of a portion of the structure of FIG. 2.

As required, a detailed illustrative embodiment of the invention is disclosed herein. The embodiment, although deemed best for present purposes and as currently contemplated, is to be recognized as exemplary. Also, it is to be recognized that the present invention may be constructed in various other forms, some of which may be quite different from the disclosed illustrative embodiment. However, the specific structural and functional details disclosed herein are deemed to be merely representative and in that regard provide a basis for the claims herein which define the scope of the invention.

Referring initially to FIG. 1, the bank is shown to provide a coin receptacle 10 which receives coins as for deposit. In association with the deposit of a coin (or independently thereof) a handle 12 may be manually actuated as a lever to motivate a set 14 of spinning reels. The individual reels of the set 14 bear symbols or indicia 16 which are displayed through three aligned windows 18. Essentially, predetermined combinations of the indicia 16 displayed in the windows 18 by the set 14 of reels are designated as winning combinations to result in the return of coins.

In use, as the handle 12 is actuated the reels are set in motion then stopped in sequence to establish a specific set of positions, which may or may not present a winning combination as manifest by the indicia 16. Upon accomplishment of one of the winning combinations, the bank returns an appropriate number of coins to the depositor through a cup 20, which coins may then be used for replay. As a consequence, the depositor generally enjoys the act of depositing coins in the bank. Also, the apparatus may be operated as a skill device, somewhat as described in the above-referenced patent.

Considering the structure of the illustrative embodiment in somewhat greater detail, the unit is enclosed by a rear housing 22 and a front cover 24 both of which may be formed of molded plastic. These members may be locked or otherwise fixed together over the internal mechanism including the set 14 of reels along with a control mechanism, coin-handling apparatus and a coin dispensing structure as disclosed in greater detail below.

The handle 12 (right of FIG. 1) is affixed to a traverse shaft 34 (FIG. 2) which is journaled into bearings mounted in the opposed facing sides 30 and 32 of an internal sheet-metal frame that is completed by a base member 26. The individual reels 38, 39 and 40 are also supported between the sides 30 and 32 for independent rotary motion on a shaft 41. The reels each incorporate spiders or stars 42 and radially-recessed indices 43 which may be integrally formed with each reel. The reels are set in motion through a gear drive mechanism 45 and are stopped in different positions to display different indicia patterns as associated individual stopping mechanisms 47 are released to engage fingers 49 with the stars 42. The details of these structures are set forth in one form in the above-referenced patent wherein the reels 38, 39 and 40 are stopped in sequence as the handle 12 is moved back to a starting position, then sensed by a feeler-gauge structure 50.

At the conclusion of a spinning sequence, when the reels 38, 39 and 40 are stopped, a set of feeler arms 51, 53 and 55 (FIG. 2) are released for engagement with the indices 43. The control mechanism 56 may take a form as disclosed in greater detail in the above-identified patent wherein the feeler arms 51, 53 and 55 are controlled by the handle 12. Specifically, the feeler arms are withdrawn from engagement with the indices 43 when the handle 12 (FIG. 1) first is actuated. Subsequently, the feeler arms are released upon the final portion of the return stroke by the handle 12.

Generally, the feeler arms 51, 53 and 55 matingly engage indentations in the indices 43 on each of the reels 38, 39 and 40. In the event of a winning-position combination, one of the feeler arms encounters an aligned series of deep indentations in the indices 43. Accordingly, that feeler arm moves to an offset position closer to the center of the reels. The arms 51, 53 and 55 are mounted in spaced-apart relationship at a pivot joint 67, so that a winning combination involves a reel alignment in which one of the feeler arms, e.g. feeler arm 51 (FIG. 3) is permitted to move internally as a result of the extensions 61 thereon being aligned with deep indentations in the indices 43. Such displacement of the feeler arms actuates one of a set 60 of electrical switches. Specifically, the three feeler arms 51, 53 and 55 (FIG. 2) individually co-act with one of the switches 63, 65 or 67 in the set 60, to indicate a predetermined winning combination. In the illustrative embodiment, the upper feeler arm 51 designates the largest payout while the central arm 53 provides a lesser payout, and the lower-level arm 55 accomplishes the smallest payout.

Recapitulating with regard to the operation of the unit, normally a coin is deposited through the receptacle 10 (FIG. 1) after which the handle 12 is pulled forward to actuate the set 14 of reels. Subsequently, the reels are stopped in a positional relationship which may manifest a winning combination. Winning combinations are manifest when one of the arms 51, 53 or 55 (FIG. 2) falls into an internally-offset position (FIG. 3) to actuate one of a set 60 of switches. As indicated, the particular switch actuated determines the number of coins returned by the dispensing structure, which will now be considered.

Figure 4:
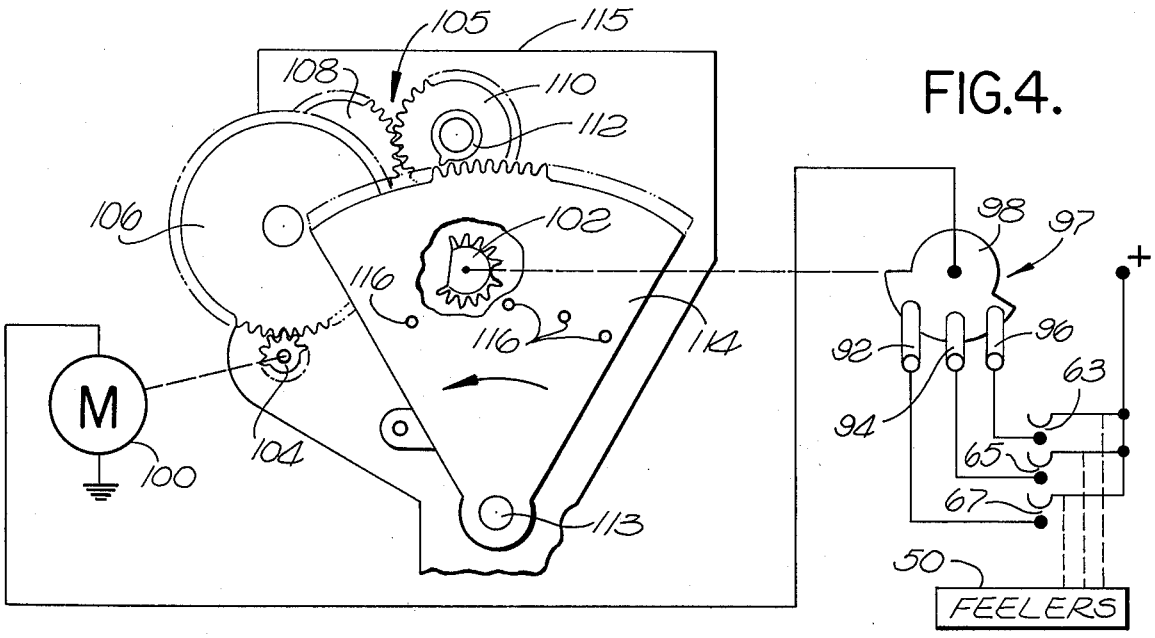
FIG. 4 is a fragmentary vertical sectional view taken along line 4—4 of FIG. 2, along with diagrammatically-represented electro-mechanical elements.

Coins dropping from the receptacle 10 (FIG. 1) fall into a stack contained by a payout tube 80 (FIG. 2). Of course, when the tube 80 is full, received coins fall past the tube 80 into a storage space. Coins are dispensed or returned from the payout tube 80 by the payout mechanism which is driven by a battery pack 82. Essentially, as described in detail below, a sliding member transports the bottom coin of the stack laterally from the tube 80 to be dropped into the cup 20 (FIG. 1). The control for such operation, as indicated above, is initiated by the feeler arms 51, 53 and 55 actuating switches 63, 65 and 67 which are schematically represented in FIG. 4. The movable contacts of each of the switches 63, 65 and 67 are connected to a source of positive potential, e.g. the battery pack 82 (FIG. 2). The fixed contacts of the switches 63, 65 and 67 (FIG. 4) are individually connected to a counter switch 97, specifically to terminals 92, 94 and 96 in sliding engagement with a rotary switch segment 98, which segment is electrically connected to a motor 100, the other terminal of which is connected to ground potential. The rotary switch segment 98 is mechanically connected to a gear segment 102 while the motor 100 is connected to a gear wheel 104. Thus, an electromechanical counter is provided.

The gear wheel 104 drives a gear train 105 including gear wheels 106, 108 and 110, the latter being mounted on a common shaft with a single-tooth gear wheel 112 which engages a gear segment 114 which carries laterally-extending pins 116 to engage and actuate the gear segment 102. The gear segment 114 is rotatably mounted on a stud 113 which extends from a support plate 115 affixed to the panel 32 (FIG. 2). Similarly, the gears 104, 106, 108 and 110 are also affixed to the support or gear plate 115, the gear wheel 108 being carried on a rotary shaft 118 (FIG. 5) which (on the opposite side of the plate 115) carries a radially-extending cam 119 carrying a pin 117 for engaging a slot 120 in an arm 124, the upper end of which is fixed at a pivot point 126. The lower end of the arm 124 is engaged by a pivot 132 to a sliding leaf 130. The flat leaf 130 defines a circular coin-receiving opening 134 which reciprocates between positions of alignment with the coin tube 80 and a coin drop 138.

In view of the above generally structural description of the apparatus, a complete understanding thereof may now best be completed by reviewing the sequence of events which follow the deposition of a coin. Accordingly, assume that a coin is deposited in the receptacle 10 (FIG. 1) to fall either into the payout tube 80 or to be deflected to the slide 84 and fall to the bottom of the housing. Next, the depositor normally pulls the handle 12 progressively forward with the result that the reels 38, 39 and 40 are actuated to a free spinning motion. The forward stroke of the lever or handle 12 also moves the gear segment 114 (FIG. 4) to the left into a cocked position.

As indicated above, the spinning reels may be variously stopped, specifically for example, as disclosed in detail in the above-referenced patent. In the event that the position combination of the reels is insignificant, then the sequence of operation is concluded because the set 60 of switches remain inactive. However, if the reels are stopped at a winning combination manifesting a select position, the appropriate feeler arm 51, 53 or 55 moves to an internal position (FIG. 3) with respect to the set 14 of reels so that an appropriate one of the switches 63, 65 or 67 is closed.

Figure 5:
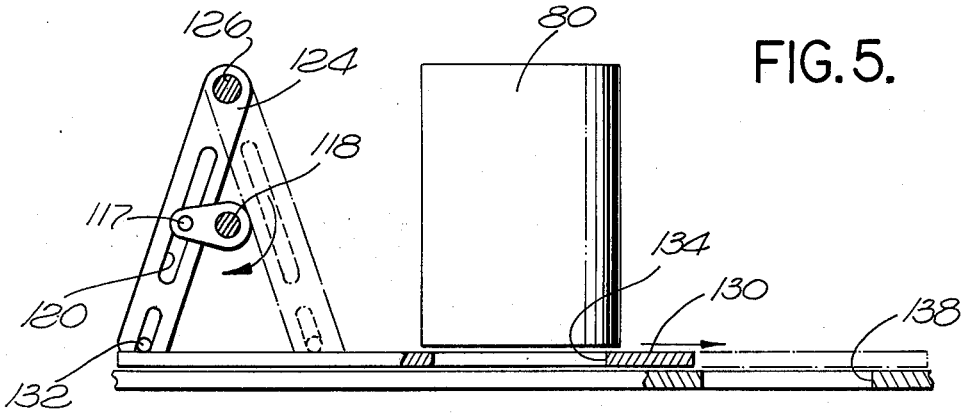
FIG. 5 is a fragmentary vertical sectional view taken along line 5—5 of FIG. 2.

Upon closure of one of the switches 63, 65 or 67 (FIG. 4) the motor 100 is energized through the counter switch 98. Thereupon, the gear wheel 104 is revolved to drive the gear wheel 108 which actuates the coin-delivery leaf 130 (FIG. 5). Essentially, each revolution of the gear wheel 108 turns the cam 119 through a revolution accomplishing a reciprocal motion by the slide 130 and the delivery of a coin. Of course, in alternative embodiments various numbers of coins may be delivered during each reciprocation. In the disclosed embodiment, a single coin is delivered during each reciprocation with the possible number of reciprocations being three, six and twelve. Specifically, the lowest-value winning combination results in the return of three coins. The next more-valuable combination, results in the delivery of six coins, and the highest-value combination results in the delivery of twelve coins.

As the leaf 130 (FIG. 5) is mechanically coupled through the shaft 118 and the gear wheels 108 (FIG. 4), 110 and 112 to the gear segment 114 the latter is angularly displaced as coins are dropped. The pins 116 on the gear segment 114 therefore move to sequentially step the gear segment 102 revolving the switch segment 98. In the event that only three coins are to be delivered, the angle through which the gear wheel 108 turns (to reciprocate the leaf 130 three times) coincides to the angle through which the gear segment 114 turns in order to step the gear segment 102 through a motion sufficient to move the contact plate 98 from under the terminal 96. As a result, after three reciprocal motions, the circuit closed through the counter switch 97 is opened thereby deenergizing the motor.

A similar sequence of operation occurs in the event that the winning combination of the reels results in the closure of the switches 65 or 67. However, in the case of the closure of the switch 65, the gear segment 102 must be moved through two steps before the segment 98 will be moved to break contact with the terminal 94. As a consequence, six coins are delivered. Similarly, in the event of the highest-value positional combination, the gear segment 102 must be actuated through three motion increments before the segment 98 breaks contact with the terminal 92, resulting in the return of twelve coins.

After a payout cycle is completed, the next cycle of operations is initiated by actuating the handle 12 (FIG. 1). Of course, as indicated above, the actuation of the handle 12 turns the shaft 34 (FIG. 4) to restore the gear segment 114 to an initial position. That motion also restores the counter switch 97 to a starting position.

In considering the structure, it is important to recognize that the illustrative embodiment is not in the form of a gambling device. Specifically, the coin receptacle 10 (FIG. 1) will accept coins without selectivity, the user controls the actual stopping of the set 14 of reels through the handle 12, and the windows 18 are open to expose the reels. Consequently, the operation of the unit may be based on either manual skill or positive action contrary to the requisite operation of a gambling device. As a somewhat related consideration, the payout unit may be variously adapted to flexibly accommodate different coins, e.g. both pennies and dimes.

It may, therefore, be seen that the electro-mechanical structure effectively responds to various winning combinations to return a predetermined number of coins. Of course, various forms of detailed structures may be provided in accordance herewith and accordingly, the scope hereof is deemed to be in accordance with the claims as set out below.

What is claimed is:

1. A toy bank, as for accumulating coins, comprising:

spinning-reel means movable to designate a plurality of predetermined winning positional combinations;

drive means for actuating said spinning-reel means and to halt said spinning-reel means in sequence under manual control in various positional combinations;

coin-delivery means including a sliding leaf and rotary means to move said leaf in a reciprocal pattern for dispensing coins;

a set of feeler arms for mechanically sensing winning positional combinations of said reels;

a plurality of switch means selectively closed by said feeler arms in accordance with specific of said winning positional combinations;

an electric motor;

a gear train for coupling said motor to said rotary means of said coin-delivery means;

a plurality of switch terminal contacts individually connected to said like plurality of switch means;

a rotary contact means including a conductive segment upon which said terminal contacts dwell;

a gear segment means coupled to said rotary contact means and actuated by said drive means for resetting said rotary contact means to receive said terminal contacts upon actuation of said drive means, said gear segment means also being actuated by said gear train for sequential stepping motion to sequentially advance said conductive segment from positions of contact with said terminal contacts in incremental steps related to rotations of said rotary means of said coin-delivery means; and means for energizing said electric motor through said switch means and said conductive segment to actuate said coin-delivery means whereby to operate said coin-delivery means in accordance with the states of said switch means as closed by said feeler arms.

2. A toy bank according to claim 1 wherein said gear segment means includes a first gear segment defining a plurality of laterally-extending pins and a second gear segment engaging said pins for actuation to advance said contact means.

* * * * *